United States Patent [19]

Granada

[11] 4,295,624

[45] Oct. 20, 1981

[54] READING STAND

[76] Inventor: Wilfredo A. Granada, 2600Elisha, Zion, Ill. 60099

[21] Appl. No.: 189,892

[22] Filed: Sep. 22, 1980

[51] Int. Cl.[3] ..... A47G 1/24

[52] U.S. Cl. ..... 248/456; 248/463

[58] Field of Search ..... 248/447, 451, 452, 453, 248/454, 455, 456, 461, 463, 465

[56] References Cited

U.S. PATENT DOCUMENTS

| | | | |
|---|---|---|---|
| 510,075 | 12/1893 | Ludgin | 248/451 |
| 590,819 | 9/1897 | Boyd | 248/451 |
| 602,736 | 4/1898 | Duboeay | 248/456 |
| 623,835 | 4/1899 | Schanz | 248/451 |
| 685,458 | 10/1901 | McIntyre . | |
| 977,397 | 11/1910 | Peterson . | |
| 1,208,622 | 12/1916 | Muller . | |
| 1,263,122 | 4/1918 | Sandstrom . | |
| 1,666,803 | 4/1928 | Walker | 248/454 |
| 1,671,058 | 5/1928 | Burke . | |
| 1,847,138 | 3/1932 | Rosenberg | 248/453 |
| 2,235,649 | 3/1941 | Shaw | 248/452 |
| 2,273,584 | 2/1942 | Moore | 248/452 X |
| 2,386,131 | 10/1945 | McCutchan | 248/447 |
| 3,029,548 | 4/1962 | Braha . | |
| 3,134,192 | 5/1964 | Huffer | 248/463 |
| 3,339,874 | 9/1967 | Kerstens . | |
| 3,381,928 | 5/1968 | White . | |

*Primary Examiner*—J. Franklin Foss

*Attorney, Agent, or Firm*—Robert E. O'Neill

[57] ABSTRACT

An adjustable support or reading stand for providing inclined support of books, papers and similar materials. The stand includes a support plate, a foldable horizontal support ledge attached to a support surface of the plate and an arcuate telescoping leg attached to the plate to adjust the inclination of the support surface. The telescoping leg includes a bearing and ratchet arrangement to provide adjustable inclination and a hinge coupling to make the leg foldable for easy and compact transportation of the stand.

4 Claims, 3 Drawing Figures

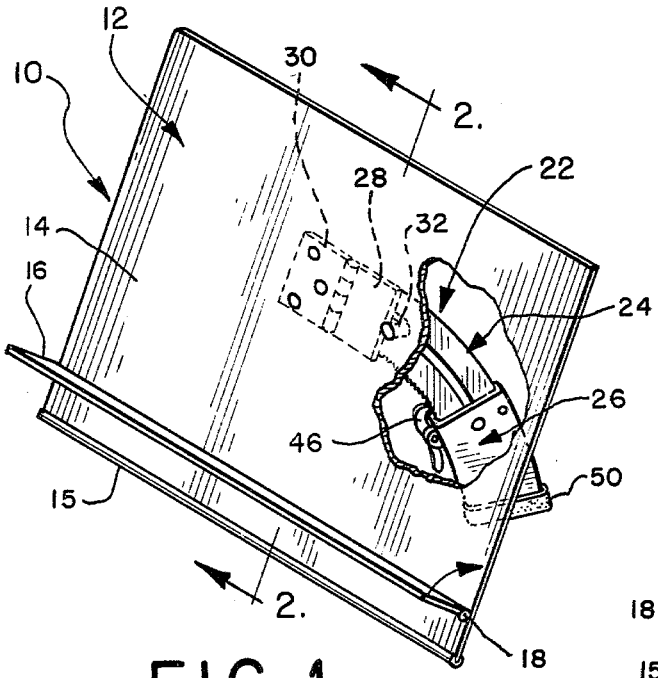
FIG. 1
FIG. 3
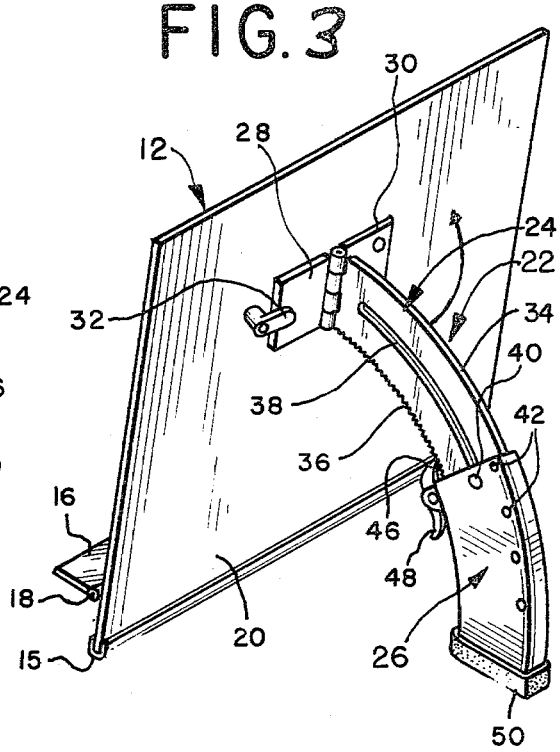
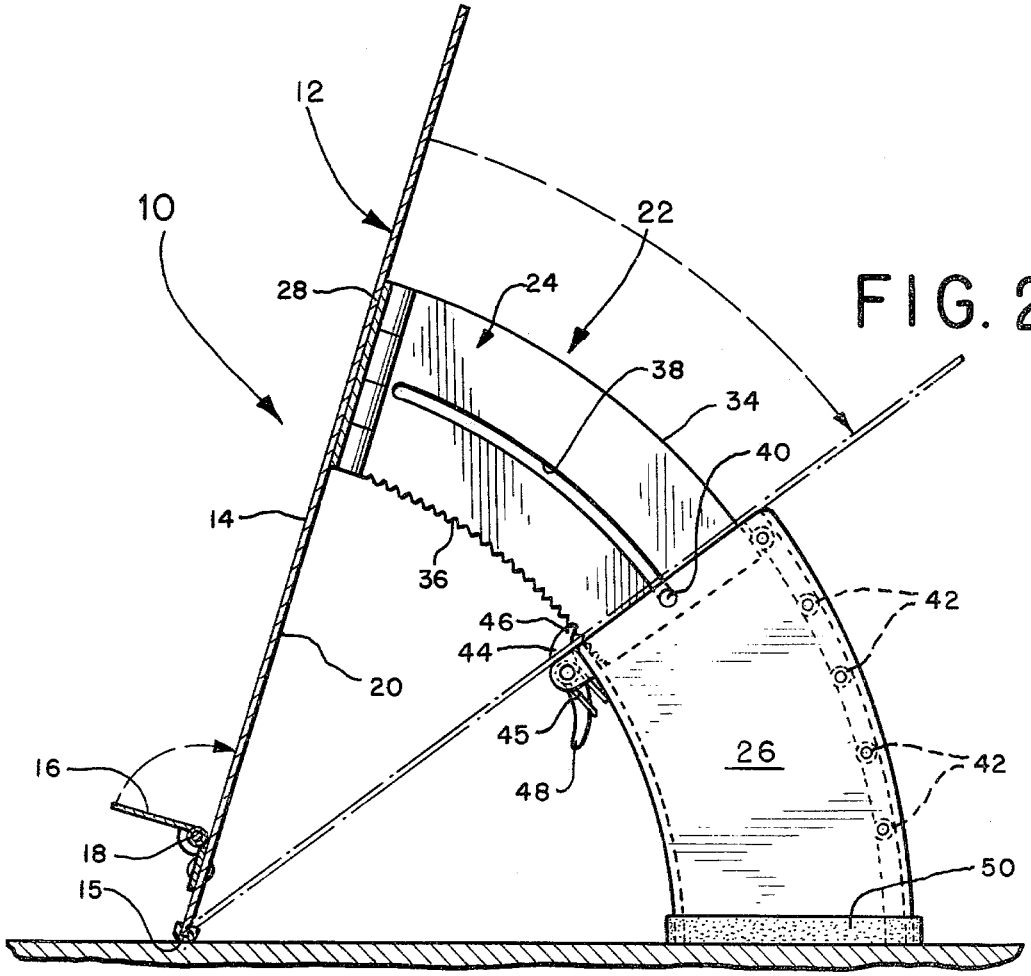
FIG. 2

READING STAND

BACKGROUND OF THE INVENTION

The present invention relates to an adjustable support device and more particularly to an adjustable reading stand which is capable of supporting material in an adjustably inclined position.

In the prior art, there are a variety of disclosed reading stands, book holders, easels, paper and pad holders, and devices for supporting numerous other sheet-like materials. Such devices generally include a primary support member having a support ledge and a foldable, adjustable leg extending from the primary member to adjust its inclination. Reading or other sheet-like material can be placed on the primary member and adjustably inclined for easy display or support. When not in use, the leg portions can be folded and the stand collapsed to allow easy storage or transportation.

As noted above, although the concept of a foldable reading or support stand has been known for some time, the particular structures disclosed include various and complex configurations for achieving specific results. In particular, many of the stands are designed to hold pads or material of specific types while others are designed to accommodate particular uses in limited environments. The structures include both wood and metal frame devices with automatic folding features, as well as devices which form their own case for transportation after collapse. Some of the devices are simple in construction while others require specific configurations and materials to accomplish their intended function.

In spite of the numerous examples of reading stands and other supports, there is still a need for devices which provide simple adjustable support with substantially universal application for most types and forms of materials. Accordingly, the present invention has been developed to overcome the shortcomings of the above known and similar devices and to provide a reading stand of simple and inexpensive construction.

SUMMARY OF THE INVENTION

As disclosed, the present invention includes a generally rectangular planar primary support member which has attached to its support surface a generally horizontally disposed ledge. The ledge is hinged so that in use it forms a surface extending perpendicular to the support surface and when not in use folds to be generally parallel and abutting to the support surface. An arcuate telescoping leg is attached to the opposite side of the primary support member. The telescoping leg is hinged at one end so that its projects generally perpendicularly from the opposite side when in use. A catch is provided to retain the leg in that position during use and to release the leg for folding during transportation and storage. The leg is formed from two cooperating arcuate sections which engage to form the telescoping leg. One section is an arcuate female member including a pin which extends through and is retained in the slot of the second section formed as an arcuate male member. The female member also includes a ratchet arm which cooperates with teeth in the male member to adjust the length of the telescoping leg. Bearings are also retained in the female member to allow easy movement of the female member over the male member. By controlling the length of the telescoping leg, the angle of inclination of the primary support member and therefore the support surface can easily be adjusted.

It is therefore a feature of the present invention to provide a reading stand or holder which is simple in construction and inexpensive to manufacture.

It is a further feature of the invention to provide a reading stand which is easily collapsible, compact and durable for easy transportation and storage.

It is another feature of the invention to provide a collapsible book or reading stand which has a foldable support ledge and foldable, adjustable arcuate leg for changing the ange of inclination.

It is still another feature of the invention to provide a collapsible book or reading stand which includes a hinged support leg wherein the support leg is a telescoping arcuate member having a ratchet and roller bearing arrangement for easy adjustment of the angle of inclination.

Other advantages and novel features of the invention will become apparent from the following detailed description when considered with the accompanying drawings wherein:

BRIEF DESCRIPTION OF THE DRAWINGS

FIG. 1 is a perspective view of the reading stand in accordance with the present invention.

FIG. 2 is a side-sectional view of the stand shown in FIG. 1 showing the telescoping leg.

FIG. 3 is a perspective view of the stand shown in FIG. 1 viewed from the rear side.

DETAILED DESCRIPTION OF A PREFERRED EMBODIMENT

Referring now to the drawings, there is shown a reading stand constructed in accordance with the present invention. In particular, in FIG. 1, the stand 10 is shown to have a generally rectangular planar primary support member 12 which can be a plate-like member constructed of wood, plastic, lightweight metal or equivalent material. While shown to be rectangular, the plate can have any suitable dimension as may be warranted under the particular circumstances of use, but generally is dimensioned to accept a wide variety of material or book sizes.

The member 12 includes a support surface 14 which forms the surface against which a book or other reading material will be supported. A support ledge 16, configured as a longitudinal strip, is hinged at 18 to the surface 14 so that it extends generally parallel to the lower edge 15 of the plate 12. The ledge 16 is constructed and hinged at 18 so that in its open position as shown in FIG. 1, the ledge forms a planar surface which extends generally perpendicular to the surface 14. The ledge is used to restrain the lower edge of a book or paper which is to be supported by the planar surface 14. When not in use, however, the ledge 16 can be folded upward about the hinge 18 so that it collapses against the surface 14.

The reading stand also includes an arcuate telescoping leg 22 which provides adjustable support of the plate 12 so that the angle of inclination relative to the horizontal can be easily adjusted. The arcuate leg 22 is constructed from two separate cooperating male and female arcuate sections 24 and 26, one of which telescopes over the other and which is adjusted by a ratchet arrangement to control the length of the telescoping leg and thus the angle of support surface inclination. The leg is attached to the rear surface of the plate 12 by a hinge arrangement (movement limited to 90°) so that in the open position the leg extends generally perpendicularly from the rear surface of plate 12.

As can be seen in FIG. 3, the male member 24 includes two hinge portions 28 and 30 which are attached to opposite sides of the member 24. Hinge 28 is constructed so that it folds flat against the male member when not in use as male member 24 folds flat against the rear of member 12 about hinge 30. The hinge 30 (movement limited to 90°) is permanently attached by fasteners or other means to the back of the support plate 12. The hinge 28 (movement limited to 90°) in its open position is retained flat against the back of the support plate 12 by a pivoted catch 32. During use the catch 32 retains the hinge 28 and thus maintains the leg 22 in its extended position. During collapse or storage, however, the catch 32 is rotated and the hinges and leg fold as previously described. In lieu of the hinge 28, a retaining ledge, extending generally perpendicular from the side of section 24 adjacent the hinge 30, could be employed to fix the leg in position. In this instance, the catch 32 could be positioned to engage the ledge to retain the leg in its extended position. In still other instances, a pivoted bar could be used to engage the ledge and retain the leg in position.

Turning now to FIG. 2, the telescoping leg 22 includes an arcuate male strip 24 having a smooth upper edge 34 and a toothed lower edge 36 opposite thereto. The strip 24 also includes an arcuate slot 38 which extends for a length between the ends of the strip 24. The slot does not have to be any particular length, but the length of the slot determines the length of the leg and therefore, the amount of adjustment of inclination as will be more particularly described below.

The leg 22 further includes an arcuate female member 26 which is configured to receive and slidably engage the arcuate strip 24. As can be seen, the member 26 is generally constructed to form a housing which telescopes over the strip 24 and which is retained on the secion 24 by a pin 40 which extends through the housing 26 and through the slot 38 when the sections 24 and 26 are combined to form the leg 22. The member 26 also includes a plurality of rollers 42 which are spaced along one edge of the arcuate member 26 so that they engage the edge 34 when member 26 is telescoped over strip 24. The rollers 42 are positioned within the member 26 so that each roller turns and provides a bearing movement against the edge 34 as the members are telescoped.

The member 26 also includes a ratchet arm 44 pivotally retained along the edge of member 26 opposite to the rollers 42. The ratchet arm is of conventional construction and is designed to cooperate with the teeth 36 to retain the member 26 in an adjustable position relative to the strip 24. The ratchet arrangement includes a spring 45 which bears against one end 48 of the ratchet arm 44 and forces the other end 46 to engage the teeth 36 thereby retaining member 26 stationary relative to strip 24. When the end 48 is depressed to release the end 46 from the teeth 36, the member 26 can be moved along bearings 42 over the strip 24 to adjust the length of the leg 22. The member 26 also includes a retaining member 50 forming a foot on the leg 22. The member 50 can be formed of rubber or other resilient material which abuts the surface on which the stand is positioned, and prevents the leg 22 from sliding easily.

As can be seen from FIGS. 2 and 3, the telescoping leg 22 enables the inclination of plate 12 to be easily adjusted. The cooperating telescoping sections 24 and 26 allow that adjustment by moving the position of ratchet arm engagement with the teeth 36. Since the pin 40 is also engaged in slot 38, and member 26 is guided by roller bearings 42, the length is easily adjusted over a substantial distance, preferably to enable the angle of inclination of surface 14 to be adjusted over a range of 40°–75° relative to the horizontal.

From the preceding description it can be seen that the present invention provides a simple and inexpensive reading stand which can be collapsed for efficient transportation and storage. The stand can be constructed using inexpensive materials, yet provide a substantial and sturdy support surface for articles for many sizes. In addition, by hinging the front ledge and the telescoping leg in the manner shown, the stand can be collapsed to take up very little space for transportation and storage. In contrast to the prior art, the arcuate leg provides a sturdy adjustable support without the need for various other cooperating structures to facilitate storage or control the inclination of the support member 12. In addition, the structure allows for the easy removal and replacement of parts in the event that a change is necessary or desired. These are features that are not shown or disclosed in the prior art.

Obviously, many other modifications and variations of the present invention are possible in light of the above teachings. It is therefore to be understood that within the scope of the appended claims, the invention may be practiced otherwise than as specifically described.

I claim:

1. A collapsible stand for retaining books and similar materials in an inclined position for reading and the like comprising:

a plate-like planar member having a supporting surface and an opposed rearward surface;

a planar strip member hinged to a lower portion of said supporting surface and extending generally horizontally to form a ledge for retaining a book or similar material, said strip being hinged so that in the open position the ledge extends to form a surface generally perpendicular to the support surface and in the closed position folds against the support surface so that it abuts and is generally parallel thereto;

a first arcuate strip section hinged to the rearward surface of said support plate, said strip section being hinged so that in an open position, the arcuate strip extends generally perpendicular from the rearward surface, and in the closed position, the strip folds against the rearward surface so that it abuts and is generally parallel thereto;

a retaining member attached to said hinged end of said arcuate strip having a surface which abuts the rearward surface when the strip is in the open position;

a catch pivotally mounted on said rearward surface to move along an arc allowing engagement of the catch with said retaining member to retain the arcuate strip in said open position;

an arcuate slot extending between opposite ends in said arcuate strip;

a plurality of saw-like teeth formed along one edge of the arcuate strip and extending the length thereof;

an arcuate female member constructed to receive said arcuate strip in sliding engagement therewith;

a pin extending through opposite sides of said female member and through said slot for sliding engagement therewith;

a plurality of roller members positioned in spaced apart relation along one edge of said female member and positioned for sliding engagement with an edge of said arcuate strip;

a ratchet arm pivotally mounted to an opposite edge of said female member;

a spring biasing the ratchet arm so that one end is pivoted to engage the saw teeth on the edge of the arcuate strip; and a resilient restraining member attached to the opposite end of said female member to form a foot, said arcuate strip and arcuate female member cooperating to form a telescoping leg which is adjusted by sliding said female member over said strip and adjusting their relative positions with said ratchet arm, said telescoping leg adjustably varying the angle of inclination of said support surface relative to a horizontal surface.

2. The stand of claim 1 wherein said support surface is generally rectangular.

3. The stand of claim 1 wherein the telescoping leg is adjustable to change the angle of inclination over a range of 40 to 75 degrees.

4. The stand of claim 1 wherein said resilient member is formed from rubber.

* * * * *